US010323207B2

(12) United States Patent
Kolekar et al.

(10) Patent No.: US 10,323,207 B2
(45) Date of Patent: Jun. 18, 2019

(54) GEAR AND ENGINE OILS WITH REDUCED SURFACE TENSION

(71) Applicants: Imperial Innovations Limited, London (GB); Ashland Licensing and Intellectual Property, LLC, Lexington, KY (US)

(72) Inventors: Anant S. Kolekar, Lexington, KY (US); Andrew V. Olver, Reading (GB); Adam E. Sworski, Catlettsburg, KY (US); Frances E. Lockwood, Georgetown, KY (US); Gefei Wu, Lexington, KY (US); Xiurong Cheng, Lexington, KY (US)

(73) Assignees: Imperial Innovations Limited, London (GB); Valvoline Licensing and Intellectual Property LLC, Lexington, KY (US)

( * ) Notice: Subject to any disclaimer, the term of this patent is extended or adjusted under 35 U.S.C. 154(b) by 409 days.

(21) Appl. No.: 14/548,850

(22) Filed: Nov. 20, 2014

(65) Prior Publication Data

US 2015/0148272 A1 May 28, 2015

Related U.S. Application Data

(60) Provisional application No. 61/907,661, filed on Nov. 22, 2013.

(51) Int. Cl.
*F01M 9/06* (2006.01)
*C10M 169/04* (2006.01)

(52) U.S. Cl.
CPC ..... *C10M 169/04* (2013.01); *C10M 169/041* (2013.01); *C10M 169/044* (2013.01); *F01M 9/06* (2013.01); *C10M 2201/041* (2013.01); *C10M 2203/1006* (2013.01); *C10M 2203/1025* (2013.01); *C10M 2205/0285* (2013.01); *C10M 2229/02* (2013.01); *C10N 2220/022* (2013.01); *C10N 2220/082* (2013.01); *C10N 2230/06* (2013.01); *C10N 2230/54* (2013.01); *C10N 2240/04* (2013.01)

(58) Field of Classification Search
CPC ..... C10M 2201/041; C10M 2229/041
USPC ..... 508/126, 208
See application file for complete search history.

(56) References Cited

U.S. PATENT DOCUMENTS 3,748,372 A 7/1973 McMahon et al.
4,160,739 A 7/1979 Stambaugh et al.
(Continued)

OTHER PUBLICATIONS

Dow Corning 200 Fluid, Product Information, Jun. 23, 1999.*
(Continued)

*Primary Examiner* — Vishal V Vasisth
(74) *Attorney, Agent, or Firm* — Wood Herron & Evans LLP

(57) ABSTRACT

A gear or engine oil or other type of lubricant, which effectively reduces churning losses in a dip lubrication system or any lubrication system where churning loss occur has a surface tension less than 28 mN/m and viscosity less than 400 mPa-sec at 25° C. (about 500 cSt at 25° C.). Formulations include Group I-IV base oil, in combination with an amount of silicone oil effective to decrease the surface tension of the oil, thereby reducing churning losses. When the base oil is prominently Group III, the coefficient of friction of the gear oil is also reduced.

17 Claims, 2 Drawing Sheets

(56) References Cited

U.S. PATENT DOCUMENTS

| | | | | |
|---|---|---|---|---|
| 4,224,173 | A | 9/1980 | Reick | |
| 5,047,159 | A * | 9/1991 | Zehler | C10M 155/02 508/208 |
| 5,320,761 | A | 6/1994 | Hoult et al. | |
| 5,583,095 | A * | 12/1996 | Kobayashi | C10M 107/00 508/207 |
| 6,372,696 | B1 | 4/2002 | Tipton | |
| 6,503,871 | B2 | 1/2003 | Martin | |
| 6,955,472 | B2 | 10/2005 | Rudd et al. | |
| 7,045,055 | B2 | 5/2006 | Ziemer et al. | |
| 7,425,524 | B2 | 9/2008 | Haire et al. | |
| 7,449,432 | B2 | 10/2008 | Lockwood et al. | |
| 7,732,389 | B2 | 6/2010 | Sullivan et al. | |
| 2003/0086203 | A1 | 5/2003 | Khan | |
| 2008/0242566 | A1* | 10/2008 | Lockwood | B82Y 30/00 508/113 |
| 2008/0248983 | A1 | 10/2008 | Goyal et al. | |
| 2011/0067957 | A1* | 3/2011 | Boccaletti | C10M 107/38 184/13.1 |
| 2011/0166052 | A1 | 7/2011 | Hee et al. | |
| 2011/0190183 | A1 | 8/2011 | Miyamoto et al. | |
| 2014/0048354 | A1 | 2/2014 | Kolekar et al. | |

OTHER PUBLICATIONS

Search Report and Written Opinion from corresponding PCT application PCT/US2014/06663, dated Apr. 8, 2015 (10 pages).

The Efficiency of a Hypoid Axle—A Thermally Coupled Lubrication Model by AS Kolekar et al. Tribology International (2012) 7 pages.

* cited by examiner

GEAR AND ENGINE OILS WITH REDUCED SURFACE TENSION

RELATED APPLICATIONS

The benefit of the filing date, Nov. 22, 2013, of provisional patent application Ser. No. 61/907,661 entitled "WINDAGE AND CHURNING EFFECTS IN DIPPED LUBRICATION" is claimed, and that application, in its entirety, is expressly incorporated herein as if fully set out herein.

STATEMENT REGARDING FEDERALLY SPONSORED RESEARCH OR DEVELOPMENT

The present invention was made with government support under Contract No. DE-EE0006427, awarded by the Department of Energy. The U.S. Government has certain rights in the present invention.

BACKGROUND OF THE INVENTION

In dip lubrication systems, also referred to as splash lubrication systems, components such as gears and crankshafts are rotated through an oil sump. The rotating components, then splash the lubricant on adjacent parts, thereby lubricating them. Drive axles and transmissions typically have several gear sets that are splash lubricated from an oil sump or reservoir. As the gears turn in the oil, the gears and bearings are coated with the circulating oil. At high speeds, the gears are essentially pumping the oil, creating a force corresponding to energy or shear losses in the fluid. Some engines are splash lubricated by the oil that is thrown from the crankshaft as it rotates. Although one does not want to unduly reduce the amount of lubricant in the system, the immersion depth of the component into the oil relates to power loss. The deeper the component is immersed in the oil, the greater the power loss. Accordingly, it is desirable to reduce power loss without decreasing the overall volume of the lubricant within the system. Modern engines use pumps to distribute the oil for moving components and there is power loss associated with the fluid friction inside the tube and the pump.

There is a need for a lubrication system and method for reducing power loss, such as in dip lubrication systems, as well as other lubrication systems with pumps, that addresses present challenges and characteristics such as those discussed above.

SUMMARY OF THE INVENTION

The present invention, in part, is premised on the realization that power loss in a lubrication system, such as a dip lubrication system including gears the like, can be reduced by lubricating the system with a lubricant having a low surface tension and a low viscosity. According to the present invention, the lubricant will have a surface tension of about 28 mN/m or less and a viscosity of less than 400 mPa-sec at 25° C. Generally, the lubricant will have a surface tension of less than 27 mN/m, such as 25 mN/m. However, when formulating a lubricant, additives that reduce surface tension tend to amplify foaming which increases power loss. The present invention includes lubricant formulations that meet the criteria of low surface tension, low viscosity and controlled foaming.

Further, the present invention is based on the realization that the selection of the appropriate lubricant in a dip lubrication system can improve efficiency, reduce energy loss and provide improved fuel efficiency. More particularly, the present invention includes a lubricant which incorporates a Group I, II, III, IV or Group V base oil in combination with a silicone oil. The use of the lubricant of the present invention in a dip lubrication system reduces power losses typically referred to as "churning" and, in certain applications, provides a reduced coefficient of friction. The present invention includes new lubricant in dip lubrication systems, as well as in formulations that are more efficient in modern engines, where the power loss caused by oil pumping is reduced. The objects and advantages of the present invention will be further appreciated in light of the following detailed description and drawings in which:

DETAILED DESCRIPTION OF THE INVENTION

Figure 1:
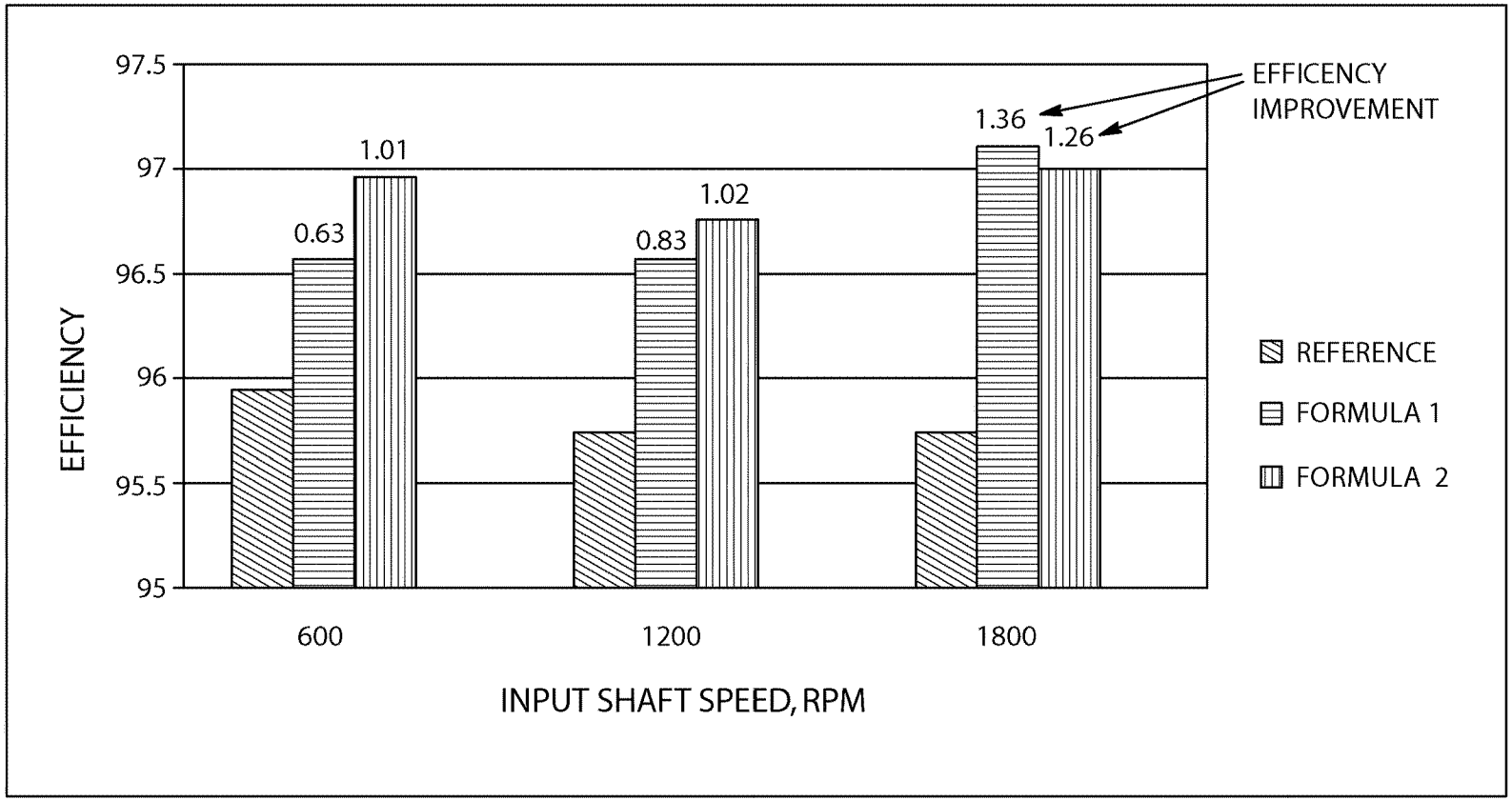
FIG. 1 is a chart showing the efficiency comparison of formulations of the present invention versus a standard formulation.

Dip lubrication is the name given to systems in which lubricants are distributed in enclosed mechanical systems, such as gearboxes, engines or axles in which a rotating component is partially submerged in a reservoir of oil. Operation of the machine and subsequent rotation of the dipped component leads to distribution of the oil to its required destination, typically the bearings or other running components within the system. Dip lubrication may be contrasted with spray or jet lubrication, in which the lubricating fluid is directly pumped by a dedicated lubrication system. Dip lubrication, therefore, incurs lower manufacturing costs. However, this is achieved by sacrificing control. For example, it is difficult in a dip system to vary the flow rate to take into account the bearing requirements of the lubricated system. In addition, dip lubrication systems are incompatible with fine filtration and can suffer from significant power losses, especially at higher rotational speeds.

In a typical gearbox, power losses occur because of the friction between the rubbing gear teeth and between the surfaces of the bearing and seal components. In addition, there are losses due to the acceleration of, and viscous dissipation within, the circulated liquid. It is this power loss, usually known as "churning", which is addressed by the present invention.

Earlier engines use a splash lubrication to supply oil to the working components using the connecting rods. The big ends of the connecting rods, often made with oil scoops, dig into a lubricant sump each time the piston passed through the bottom dead center position. Such lubrication systems were not efficient and inherently limited engine life. Certain engines employed a combined splash and forced lubrication system, also called the combined system. An engine-driven gear pump was used to deliver oil only to the main bearings; the rod bearings and other working parts were lubricated just as in the splash system. Today there are a few racing engines that use the combined lubrication system. The present invention will address churning losses in such engines.

An increase in engine power demand and reduction in size required a more reliable and consistent lubrication system. A forced lubrication system is implemented to satisfy the loads and speeds at which engine components are expected to operate. The engine bearings are lubricated and cooled by the oil circulating through them. Oil under pressure is supplied to the valve rocker arms and valve stems, crankshaft main bearings, connecting rod big-end bearings and camshaft bearings using a pump like a gerotor type. The pump extracts oil from the oil pan through a pickup tube and maintains oil pressure within a specified range using a pressure relief valve. The pumping ability for lubrication system based on the oil properties will be addressed by the present invention.

In general, a lubricant for use in the present invention will have a low surface tension and a low viscosity. For use in the present invention, the lubricant must have a surface tension of less than 28 mN/m, 27 mN/m, such as 25 mN/m or lower. Further, the viscosity of the lubricant should preferably be less than 400 mPa-sec at 25° C. (less than about 500 cSt @ 25° C.). According to the present invention, specific lubricants have been formulated which also provide reduced power loss in various lubrication systems.

A lubricant, according to the present invention, includes base oil in combination with silicone oil at the minimum. Other lubricant additives are added as needed for meeting particular lubricant specifications, including components, as specified herein, to reduce foaming. The base oil is compatible with silicone oil and the lubricant is predominantly (at least 40%) a Group I, Group II, Group III, Group IV or Group V base oil (excluding silicone oil) (as designated by the American Petroleum Institute (API)) with a viscosity of 2-100 cSt at 100° C., and preferably a viscosity index of at least 130 preferably above 160 or higher like 250. Groups I and II base oils are commonly used as gear oils in certain geographic regions, while Group III and Group IV base oils are used in other regions.

Group III base stocks are made from hydrogenation during which a mineral oil is subjected to hydrogenation or hydrocracking under special conditions to remove undesirable chemical compositions and impurities, resulting in a mineral oil-based oil having synthetic oil components and properties. Typically the hydrogenated oil defined as Group III is petroleum-base stock with a sulfur level less than 0.03, severely hydro-treated and iso-dewaxed, with saturates greater than or equal to 90 and a viscosity index greater than or equal to 120.

The Group IV base stocks are polyalphaolefins. Polyalphaolefins (PAOs) are also hydrocarbon-base stock oil, well-known in the lubricating oil trade. PAOs are derived by the polymerization or co-polymerization of alphaolefins having 2 to 32 carbons. More typically, C8, d10, C12, C14 olefins or mixtures thereof.

Group V base stocks are classified as all base stocks other than Group I, II, III and IV. Examples include phosphate ester, polyalkylene glycol (PAG), polyolester, biolubes, etc. Mainly these base stocks are mixed with other base stocks to enhance the oil performance. Esters are common Group V base oils used in different lubricant formulations including engine and gear oils. Ester oils improve performance at higher temperatures and will increase drain intervals by providing superior detergency compared to PAO synthetic base oil. For purposes of the present invention, silicone oil, which is a Group V oil, is not used as the base oil in the present invention.

For use in the present invention, the base oil will comprise 40 to about 95% of the gear oil of the present invention with the additive package being 5 to 60% by weight.

In addition to the base oil for use in the present invention, the gear oil of the present invention will include 0.01 to about 5 wt % of silicone oil. Silicone oil acts to reduce surface tension and, in combination with Group III base oils, reduces the coefficient of friction. The silicone oil can be used in amounts from about 0.01 to about 5%, 0.02 to about 0.5%, 0.1 to 0.5% with good results achieved at 0.2% silicone oil. A wide range of different viscosities can be used, including 10, 20, 50, 100, 350, 1000, 5000, 10,000 and 60,000 centistokes at 25° C. Suppliers of such silicone oils include Xiameter PMX-0245, Dow Corning 200 and 510. The higher viscosity silicone oils reduce friction, but tend to separate from the base oil. Lower viscosity silicone oil remains dispersed in the base oil. Therefore, viscosities of 10-350 cSt are advantageous, particularly 10-50 cSt at 25° C. In general, any surfactant that reduces the surface tension less than 28 mN/m is helpful in reducing the power loss.

In addition to the base oil for use in the present invention, the gear oil of the present invention will include 0.01 to about 5 wt % of silicone oil. Silicone oil is any of a group of siloxane polymers based on a structure consisting of alternate silicon and oxygen atoms with various organic radicals attached to the silicon. Silicone oil acts to reduce surface tension and, in combination with Group III base oils, reduces the coefficient of friction. The silicone oil can be used in amounts from about 0.01 to about 5%, 0.02 to about 0.5%, 0.1 to 0.5% with good results achieved at 0.2% silicone oil. A wide range of different viscosities can be used, including 10, 20, 50, 100, 350, 1000, 5000, 10,000 and 60,000 centistokes at 25° C. Suppliers of such silicone oils include Xiameter PMX-0245, Dow Corning 200 and 510. Silicone oil Dow Corning 200 is described in U.S. Pat. No. 7,273,837 as polydimethylsiloxane. U.S. Pat. No. 8,592,376 states that Dow Corning Xiameter PMX-0245 is cyclopentasiloxane. U.S. Pat. No. 5,789,340 states that Dow-Corning 510 Silicone Fluid is a mixture of dimethyl and methyl phenyl siloxanes. The higher viscosity silicone oils reduce friction, but tend to separate from the base oil. Lower viscosity silicone oil remains dispersed in the base oil. Therefore, viscosities of 10-350 cSt are advantageous, particularly 10-50 cSt at 25° C. In general, any surfactant that reduces the surface tension less than 28 mN/m is helpful in reducing the power loss.

Interestingly, nanographite particles can also act as an excellent antifoaming agent when used with a surfactant. When nanoparticles are added in the formulation, the addition of other antifoaming agents may not be needed. This is a new use for nano particles in gear oils.

Other typical additives include antifoaming agents such as Nalco EC 9286F-655, Munsing Foam Band 159, High-Tech 2030, Tego D515 and Xiameter AFE-1430; dispersant such as HiTec 5777; DI additive package such as HiTEC 355 and Anglamol 900IN; viscosity index improvers such as HiTec 5738; viscosity improvers such as HiTec 5760; and seal swell agents such as HiTEC 008.

Five formulations for use in the present invention are listed in Table 1:

| | Formula 1 | Formula 2 | | Formula 3 |
|---|---|---|---|---|
| PAO 100 | 10.00 | 10.00 | Yubase 4+ | 60.3 |
| PAO 4 | 33.95 | 37.15 | HT 5760 | 11.5 |
| HT5777 | 3.00 | 3.00 | HT 5777 | 1.5 |
| Lubrisyn 170 | 12.30 | 8.30 | HT 5738 | 2 |
| Hatcol 3110 | 10.00 | 10.00 | HT 008 | 8 |
| LZ 9001N | 10.00 | — | HT 355 | 11.2 |
| HT 355 | — | 11.20 | Nanographite | 5 |
| Nanographite | 17.80 | 17.80 | Silicone oil | 0.5 |
| O#203233G | 2.50 | 2.50 | | |

-continued

| | | | |
|---|---|---|---|
| Silicone oil | 0.5 | 0.5 | |

| | Formula 4 | | Formula 5 |
|---|---|---|---|
| PAO 4 | 54.6 | Yubase 4+ | 64.40 |
| HT 5760 | 7.2 | HT 5760 | 14.20 |
| HT 5777 | 1.5 | HT 5738 | 2 |
| HT 5738 | 2 | HT 008 | 8 |
| Viscobase 11-522 | 10 | HT 355 | 11.2 |
| HT 008 | 8 | Defoamer | 0.10 |
| HT 355 | 11.2 | Silicone oil | 0.10 |
| Nanographite | 5 | | |
| Silicone oil | 0.5 | | |

Figure 2:
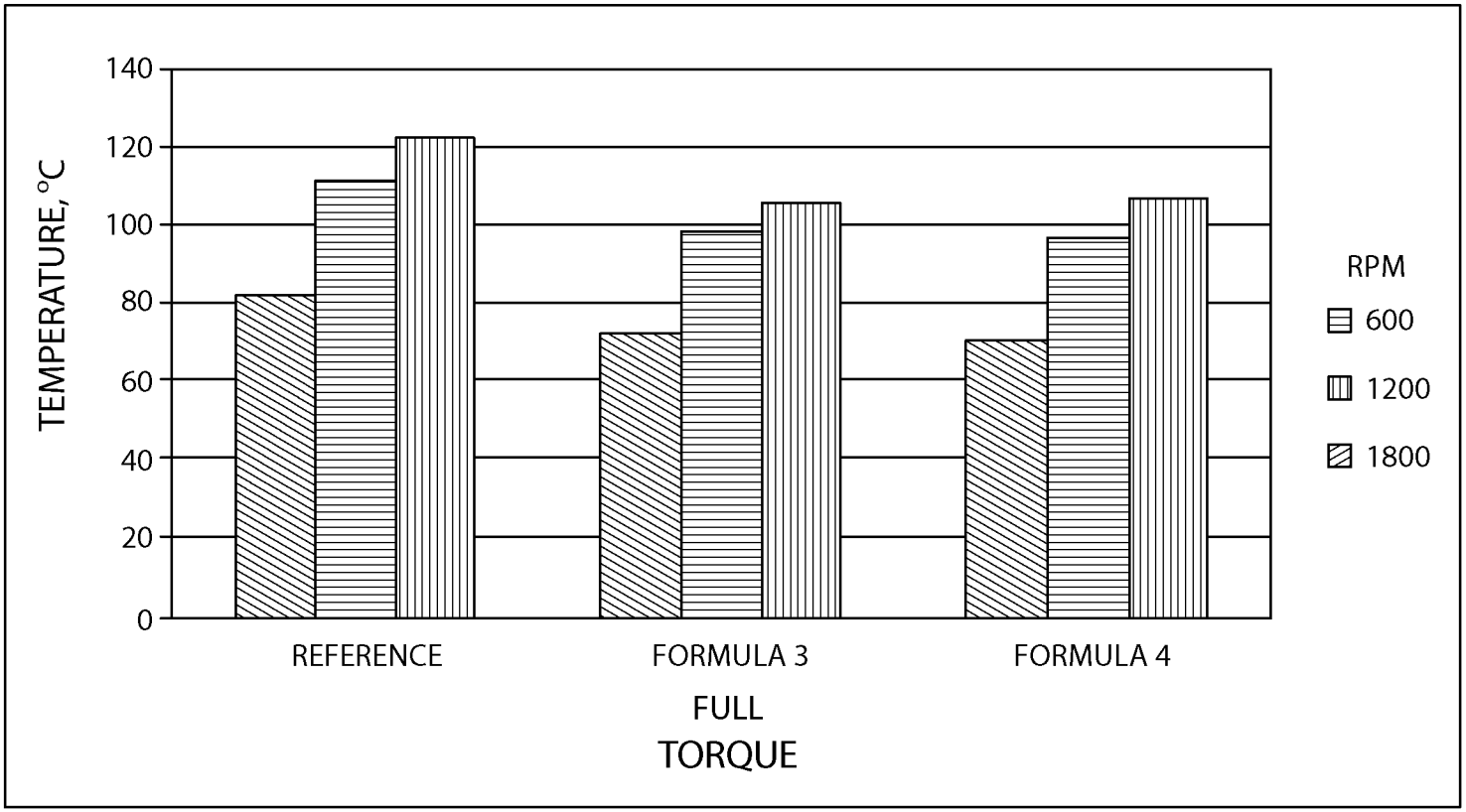
FIG. 2 is a chart showing the temperature comparison of formulations of the present invention versus a standard lubricant.

A reference lubricant formed from 64.6% Yubase 4 base oil in an additive package similar to Formulas 3 and 5 was prepared. The reference lubricant did not include silicone oil or nanographite. The surface tension of the reference lubricant was 28.91, whereas Formula 3 has a surface tension of 22.19 and Formula 5 has a surface tension of 24.28. These were subjected to a modified SAE J1266 axle test. The results of these tests are shown in FIGS. 1 and 2. As shown, the gear oils of Formula 3 and 4 showed a temperature reduction of up to 16.37° C. These three lubricants were tested for varying slide-roll ratios. Formulas 3 and 4 exhibited lower coefficients of friction than the reference lubricant.

A PAO-based reference lubricant was formed with a surface tension of 30.23 and compared with Formulas 1-5. Each oil was then tested for four slide-roll ratios and three temperatures at 1 GPa contact pressure. The reference oil had the highest friction coefficient. Formulas 2 and 4 gave a lower friction coefficient for low to medium entrainment speeds and all five formulas performed similarly.

Thus, by adding the silicone, the surface tension is reduced and the efficiency is improved. This works with all types of base oils, in particular Groups III and IV.

This has been a description of the present invention along with the preferred method of practicing the present invention; however, the invention itself should only be defined by the appended claims wherein

We claim:

1. A lubricating oil comprising:

a base oil selected from the group consisting of Group I-IV base oils;

an amount of silicone oil which remains dispersed in said base oil effective to decrease the surface tension of said base oil to less than 28 mN/m, said silicone oil having a backbone containing alternate silicon and oxygen, said lubricating oil having a viscosity less than 500 cSt at 25° C., and wherein said silicone oil is selected from the group consisting of cyclopentasiloxane, polydimethylsiloxane, a mixture of dimethyl and methyl phenyl siloxanes, and combinations thereof.

2. The lubricating oil claimed in claim 1 comprising other lubricant additives from about 5 to 60%.

3. The lubricating oil claimed in claim 1 comprising 0.01 to about 5 wt % silicone oil based on the total weight of the gear oil.

4. The lubricating oil claimed in claim 3, comprising from about 0.01 to 0.5% silicone oil.

5. The lubricating oil claimed in claim 3, comprising about 0.2% silicone oil.

6. The lubricating oil claimed in claim 1, wherein said base oil is a Group III base oil.

7. The lubricating oil claimed in claim 1, wherein said base oil is at least 40% PAO.

8. The lubricating oil claimed in claim 7, comprising at least 40 to about 95% PAO.

9. The lubricating oil claimed in claim 1, wherein said base oil has a viscosity index of 130 to about 200.

10. The lubricating oil claimed in claim 1, wherein said silicone oil has a viscosity of 10 to about 60,000 cSt at 25° C.

11. The lubricating oil claimed in claim 1 further comprising 0.01 to 15% nanographite particles.

12. A method of lubricating a dip lubrication system comprising adding a gear oil as claimed in claim 1 to said dip lubrication system.

13. A method of lubricating a dip lubrication system comprising adding a gear oil as claimed in claim 8 to said dip lubrication system.

14. A method of providing lubrication in a dip lubrication system, said method comprising:

circulating through said dip lubrication system;

a lubricant having a surface tension of less than 25 mN/m (standard gear/engine oil) and a viscosity less than 400 mPa·sec at 25° C., said lubricant comprising the lubricant oil of claim 1.

15. The method claimed in claim 14 wherein said lubricant comprises at least 40% of a Group III or Group IV base oil in combination with 0.01 to 5% by weight silicone oil.

16. The method claimed in claim 15 wherein said lubricant further includes 0.1 to 5% nanographite particles that can act as an antifoaming agent.

17. A gear oil comprising:

a base oil selected from the group consisting of Group III and Group IV base oils and mixtures thereof;

an amount of silicone oil effective to decrease the surface tension of said base oil to less than 25 mN/m, said gear oil having a viscosity less than 500 cSt at 25° C.;

wherein said amount of silicone oil is from 0.1 to 0.5% by weight of said gear oil, and said silicone oil having a backbone containing alternate silicon and oxygen, wherein said silicone oil is selected from the group consisting of cyclopentasiloxane, polydimethylsiloxane, a mixture of dimethyl and methyl phenyl siloxanes, and combinations thereof.

* * * * *